US007252525B2

(12) United States Patent
Ide et al.

(10) Patent No.: US 7,252,525 B2
(45) Date of Patent: Aug. 7, 2007

(54) NESTLED CONNECTOR COUPLING STRUCTURE

(75) Inventors: Takehisa Ide, Sakura (JP); Shigeru Ishikawa, Sagamihara (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 11/404,936

(22) Filed: Apr. 17, 2006

(65) Prior Publication Data

US 2006/0240696 A1 Oct. 26, 2006

(30) Foreign Application Priority Data

Apr. 20, 2005 (JP) ..... 2005-122583
May 31, 2005 (JP) ..... 2005-159882

(51) Int. Cl.
*H01R 13/64* (2006.01)

(52) U.S. Cl. ..... 439/248; 439/350; 439/565; 439/247

(58) Field of Classification Search ..... 439/248, 439/247, 544, 565, 350
See application file for complete search history.

(56) References Cited

U.S. PATENT DOCUMENTS

| | | | | |
|---|---|---|---|---|
| 5,472,357 | A | 12/1995 | Yamanashi | |
| 6,045,410 | A | 4/2000 | Norizuki et al. | |
| 6,217,358 | B1 * | 4/2001 | Norizuki et al. | 439/247 |
| 6,666,728 | B2 * | 12/2003 | Tachi et al. | 439/701 |
| 2002/0151202 | A1 | 10/2002 | Tachi et al. | |

FOREIGN PATENT DOCUMENTS

| | | | |
|---|---|---|---|
| JP | 11-191456 | A | 7/1999 |
| JP | 11-354208 | A | 12/1999 |
| JP | 11-354209 | A | 12/1999 |
| JP | 2000-123916 | A | 4/2000 |
| JP | 2000-123917 | A | 4/2000 |
| JP | 2000-150075 | A | 5/2000 |
| JP | 2000-215944 | A | 8/2000 |
| JP | 2003-217751 | A | 7/2003 |
| JP | 2005-93270 | A | 4/2005 |
| JP | 2005-166348 | A | 6/2005 |
| JP | 2005-166349 | A | 6/2005 |
| JP | 2005-174823 | A | 6/2005 |
| JP | 2005-183033 | A | 7/2005 |
| JP | 2005-190720 | A | 7/2005 |

* cited by examiner

*Primary Examiner*—Tho D. Ta
*Assistant Examiner*—Vanessa Girardi
(74) *Attorney, Agent, or Firm*—Sughrue Mion, PLLC

(57) ABSTRACT

A connector coupling structure includes first and second connectors including housings. A raised portion is formed at a front end side of an inner surface of the second connector housing. When the first and second connectors are coupled, the raised portion contacts an outer surface of the first connector housing, forming a clearance between the outer surface of the first connector housing and an inner surface portion of the second connector housing. An inner case is slidably received in one of the connector housings. A projecting portion is formed on a side of the inner case and a notching piece having a pawl is formed on the one connector housing to be releasably engageable with the projecting portion. When the terminals and terminal-inserting holes of the two connectors are connected with one another, the inner case slides so that the engagement of the pawl and the projecting portion is released.

11 Claims, 11 Drawing Sheets

NESTLED CONNECTOR COUPLING STRUCTURE

CROSS-REFERENCE TO RELATED APPLICATION

This application is based upon and claims the benefit of priority from Japanese Patent Applications Nos. 2005-122583 and 2005-159882, filed Apr. 20, 2005 and May 31, 2005, respectively, in the Japanese Patent Office, the disclosures of which are incorporated herein in their entirety by reference.

BACKGROUND OF THE INVENTION

1. Field of the Invention

Devices, systems, and methods consistent with the present invention relate to a connector coupling structure for coupling connectors which are used to connect a wire harness with accessories, such as audio equipment and vehicular meters, of an automotive vehicle and the like.

2. Description of the Related Art

In a conventional example of a connector coupling structure, in which audio equipment is mounted on an instrument panel of an automotive vehicle, a wire harness extends from a power supply to the panel, and the distal end of the wire harness is connected to a female connector, which in turn is coupled to a male connector provided on the back side of the audio equipment. A coupling operation of the male connector and the female connector is carried out at a back side of the instrument panel. After a completion of the coupling operation, the next operation, i.e., securing the audio equipment to the instrument panel is carried out. As described, such a conventional structure inevitably involves a two-step operation, and therefore, working efficiency is decreased. Moreover, a problem arises in which the wire harness has a slack due to a margin of the length thereof after installation of the audio equipment whereby abnormal noise is produced.

Therefore, structures have been developed in which positional deviation between a male connector and a female connector is absorbed by the connectors themselves in order to increase assemble-ability thereof and to realize an easy and reliable connection between the connectors. One of the structures is formed of a female connector and a male connector. The female connector consists of a housing, a guide for enabling the housing to slide, a first columnar projection provided on the guide, and a second columnar projection provided on the housing. The male connector consists of a housing for the male connector, a lever, terminals for the female connector and terminals for the male connector, both provided on the housing for the male connector, and a guidance groove for guiding the first columnar projection and the second columnar projection. Both housings are coupled by treating the first columnar projection inside the guidance groove as a point of action, by treating the second columnar projection as a power point, and by moving the housing for the female connector in a connection direction with respect to the male connector (see Japanese Patent Application, First Publication No. 2000-215944 (page 4, FIG. 3)).

The above official publication discloses a male connector which is provided with two U-shaped levers disposed symmetrically with respect to one another, each lever consists of plate portions extending parallel with one another, the plate portions of the each lever are coupled to an upper surface and a lower surface of the male connector at one end side of each of the plate portions and are connected to one another at the opposite end side of the plate portions. With lever grooves formed on each lever along which the first columnar projection and the second columnar projection are guided, both connectors are coupled to one another. The levers which function as a cam are structurally important. In the conventional structure, such a cam or levers are essential parts, and therefore, there become a number of parts to be assembled, thus resulting in increased cost of production. Further, another problem arises in which the degree of freedom in design of modules is low, since such a cam or levers are substantially large.

SUMMARY OF THE INVENTION

In consideration of the above circumstances, an object of the present invention is to provide a new connector coupling structure which does not have such a conventional lever and which is somewhat down-sized and manufactured at low cost, and enables a three-dimensional alignment in three directions of X, Y and Z axes to increase the degree of freedom in the design of modules.

In order to achieve the above objects, in accordance with the present invention, a connector coupling structure is provided comprising: a first connector including a housing and a plurality of terminal-inserting holes; a second connector including a housing and a plurality of terminals which are connectable to their respective terminal-inserting holes; a raised portion which is formed at a front end side of an inner surface of the second connector housing, wherein, when the first and second connectors are coupled, the raised portion is in contact with an outer surface of the first connector housing such that a clearance is formed between the outer surface of the first connector housing and an inner surface portion other than the raised portion of the second connector housing; an inner case which is slidably received in one connector housing of the first connector housing and the second connector housing and which includes one of the plurality of terminal-inserting holes and the plurality of terminals; a projecting portion which is formed on a side of the inner case; and a notching piece which is formed on said one connector housing and which includes a pawl releasably engageable with the projecting portion; wherein, when the plurality of terminals and the plurality of terminal-inserting holes are connected with one another, the inner case is slid such that the engagement of the pawl and the projecting portion is released.

Preferably, the first connector is a female connector and the second connector is a male connector.

Further, preferably, the inner case includes the plurality of terminal-inserting holes and is slidably received in the first connector housing.

Still further, preferably, when the housing of the first connector is mounted to a panel through an opening of the panel, the housing includes a housing body portion, which does not pass through the opening of the panel but is engaged with one surface of the panel, and a plurality of spring pieces, which are resiliently deformable so as to pass through the opening and are resiliently engaged with an other surface of the panel.

Yet further, preferably, when the housing of the second connector is mounted to a panel through an opening of the panel, the housing includes a housing body portion, which does not pass through the opening of the panel but is engaged with one surface of the panel, and a plurality of spring pieces, which are resiliently deformable so as to pass through the opening and are resiliently engaged with an other surface of the panel.

Another object of the present invention is to provide a new connector coupling structure which does not have such a conventional bulky cam member and which is somewhat down-sized and can be manufactured at low cost, and enables an efficient absorption of error in a fitting direction.

In order to achieve the above objects, in accordance with the present invention, a connector coupling structure is provided comprising: a first connector including a housing and a plurality of terminal-inserting holes; a second connector including a housing and a plurality of terminals which are connectable to their respective terminal-inserting holes; an inner case which is slidably received in one connector housing of the first connector housing and the second connector housing and which includes one of the plurality of terminal-inserting holes and the plurality of terminals; and a U-shaped spring piece which is provided on a side of the inner case; a rib which is provided on said one connector housing and is releasably engageable with the U-shaped spring piece, wherein, when the rib is engaged with the U-shaped spring piece, sliding movement of the inner case in said one connector housing is stopped; a channel which is provided on a side of the other connector housing of the first and second connector housings and which guides a movement of the rib and the U-shaped spring piece; and a deflection permitting window which is provided partway along the channel and which receives a resiliently deformable portion of the U-shaped spring piece; wherein, when said one connector housing, in which the inner case has been partway received, and said the other connector housing are fitted to each other, the U-shaped spring piece of the inner case comes to a position corresponding to the deflection permitting window in such a manner that the deflection permitting window makes the U-shaped spring piece open to release an engagement of the rib such that a fitting degree of both the connector housings is enlarged.

Preferably, the first connector is a female connector and the second connector is a male connector.

Further, preferably, the inner case includes the plurality of terminal-inserting holes and is slidably received in the first connector housing.

Still further, preferably, when the housing of the first connector is mounted to a panel through an opening of the panel, the housing includes a housing body portion, which does not pass through the opening of the panel but is engaged with one surface of the panel, and a plurality of spring pieces, which are resiliently deformable so as to pass through the opening and are resiliently engaged with an other surface of the panel.

Yet further, preferably, when the housing of the second connector is mounted to a panel through an opening of the panel, the housing includes a housing body portion, which does not pass through the opening of the panel but is engaged with one surface of the panel, and a plurality of spring pieces, which are resiliently deformable so as to pass through the opening and are resiliently engaged with an other surface of the panel.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

BRIEF DESCRIPTION OF THE DRAWINGS

The above features and advantages of the invention will become more apparent by describing in detail exemplary embodiments thereof with reference to the attached drawings in which.

DETAILED DESCRIPTION OF THE INVENTION

Exemplary embodiments of the invention will now be described below with reference to the attached Figures. The described exemplary embodiments are intended to assist the understanding of the invention, and are not intended to limit the scope of the invention in any way.

First Embodiment

Hereinafter, a first embodiment according to the present invention will be exemplarily described with reference to FIGS. 1 through 8.

Figure 1:
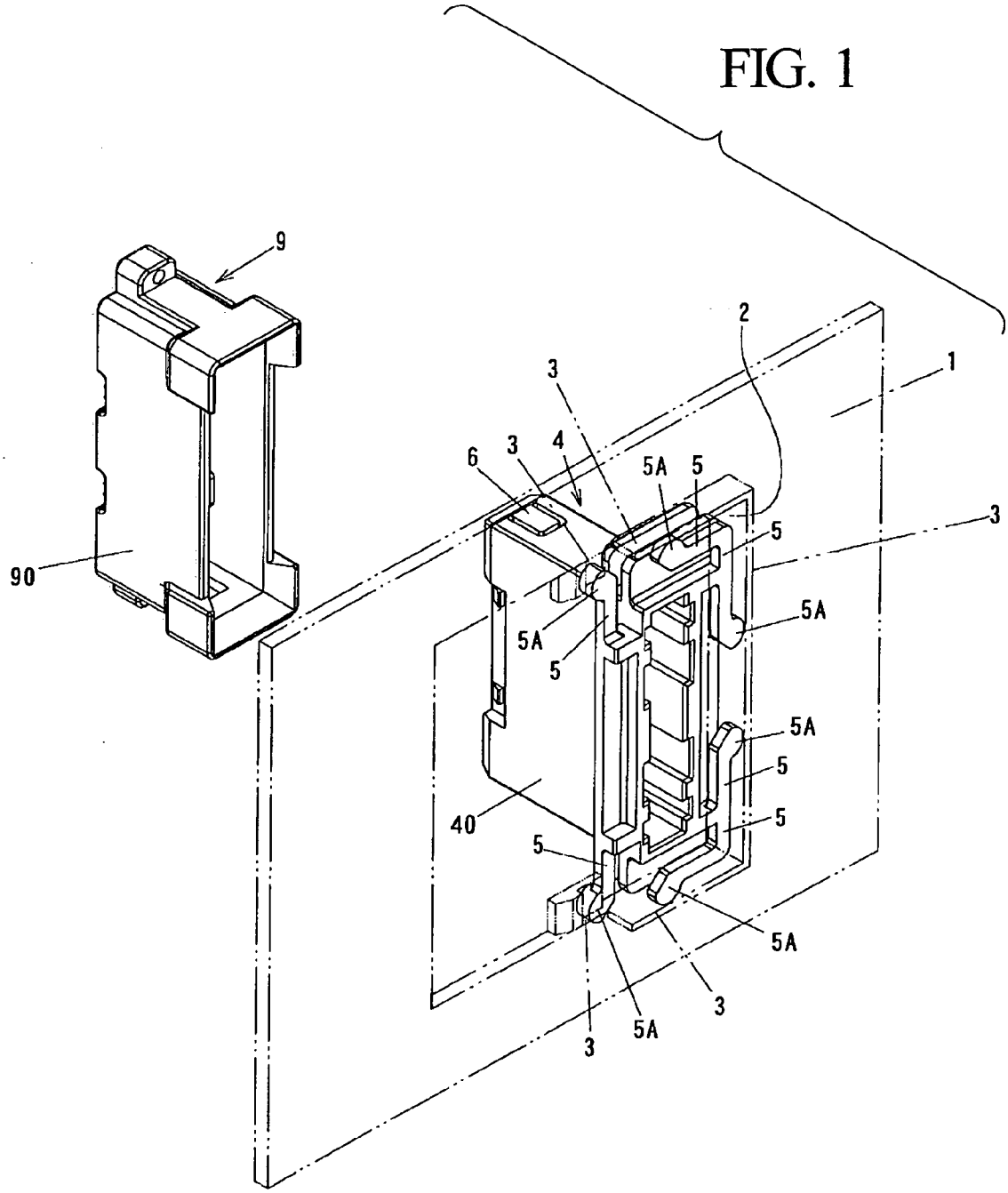
FIG. 1 is a perspective view illustrating a panel before coupling connectors, as viewed from a back side of the panel, according to a first embodiment of the present invention.

FIG. 1 is a view illustrating a securement state of a female connector 4 with respect to a panel 1, such as an instrument panel or the like, to which one connector is to be secured, when viewed from the back of the panel 1. The panel 1 is formed with an opening 2, in which the female connector 4 is mounted. A catching wall 3 is formed along the periphery of the opening 2 at a panel back side. This catching wall 3 is comprised of a portion that is formed in such a manner as to protrude from a back surface of the panel 1, and of a peripheral wall that is flush with the opening 2. On a back surface of the female connector 4 is formed a plurality of spring pieces 5, each of which has a tip 5A that is an outwardly rounded bulging portion. Each of the tips 5A (or rounded bulging portions) of the spring pieces 5 is brought into resilient contact with the aforesaid catching wall 3 whereby the female connector 4 is secured to the panel 1. The tips 5A of the spring pieces 5 bulge in such a manner as to protrude outwardly from outlines by which the back surface of the female connector 4 is defined. Under a state in which the tips 5A of the spring pieces 5 are in resilient contact with the catching wall 3, positioning control of the female connector 4 in X and Y axial directions is possible. When a housing 40 of the female connector 4 is molded from a resin material, the aforesaid spring pieces 5 are also integrally formed with the housing 40. The spring pieces 5 are provided on a rectangular-shaped back surface of the female connector 4, one at each short side (or each of upper and lower sides) of the rectangular shape and two at each long side (or each of left and right sides) of the rectangular shape.

Further, notching pieces 6 with C-shaped incisions formed thereon are provided, one at each of top and bottom portions of a front side of the housing 40 of the female connector 4. An inner case 8 with a number of terminal-inserting holes 7, as more fully discussed hereinafter, is housed in the housing 40 so as to be slidable therein. This inner case 8 is provisionally secured in position by means of pawls 11 that are formed in the notching pieces 6 (details thereof will be described hereinafter).

A male connector 9 is fitted in the female connector 4. In FIG. 1, a number of male terminals 10 to be inserted in their respective terminal-inserting holes 7 are not illustrated, and instead, a housing 90 to house those male terminals 10 is only illustrated. This housing 90 is fitted on the aforesaid housing 40 so as to cover thereof. The male connector 9 is provided at a back side of accessories such as vehicular meters.

Figure 2:
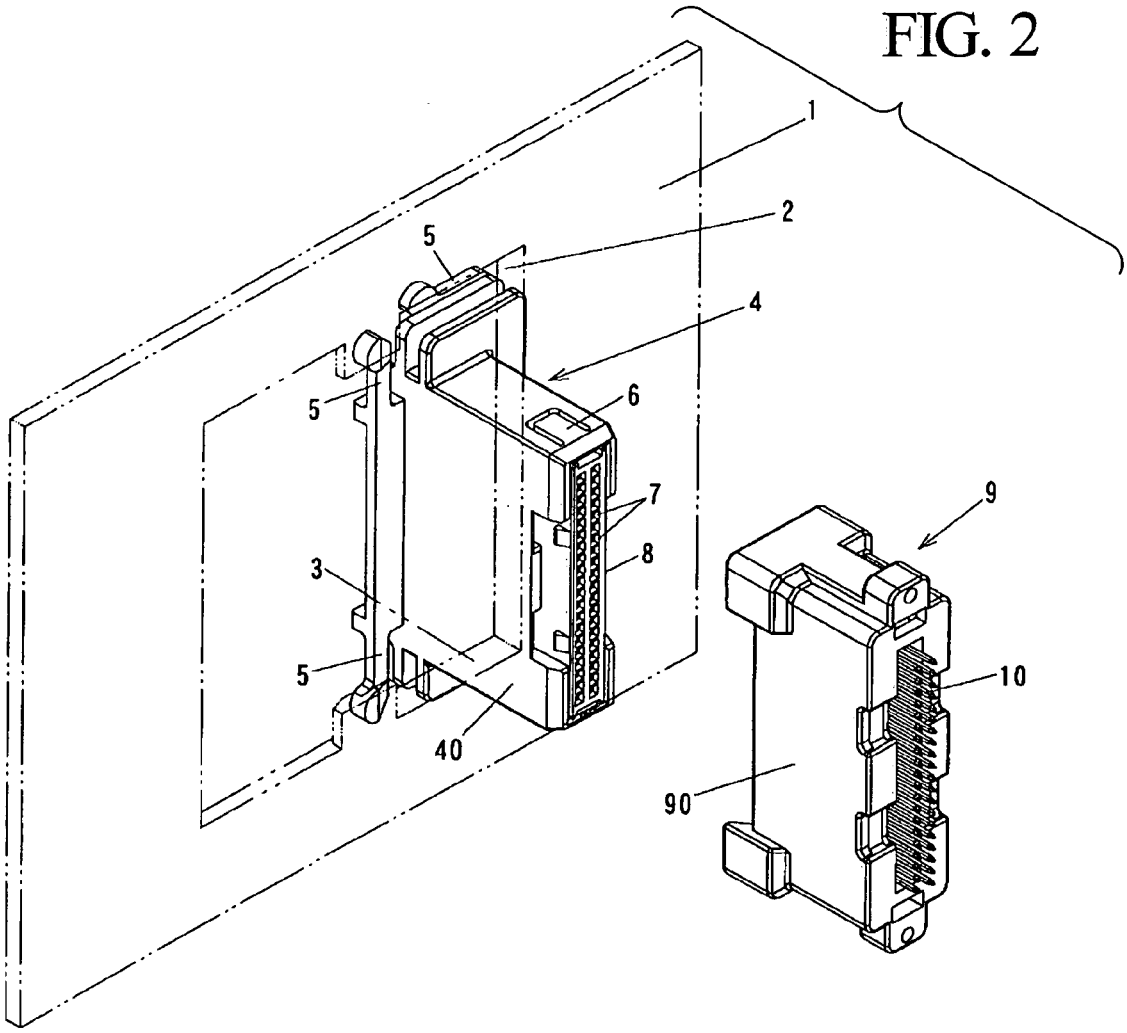
FIG. 2 is a perspective view illustrating the panel before coupling the connectors, as viewed from a front side of the panel.
Figure 3:
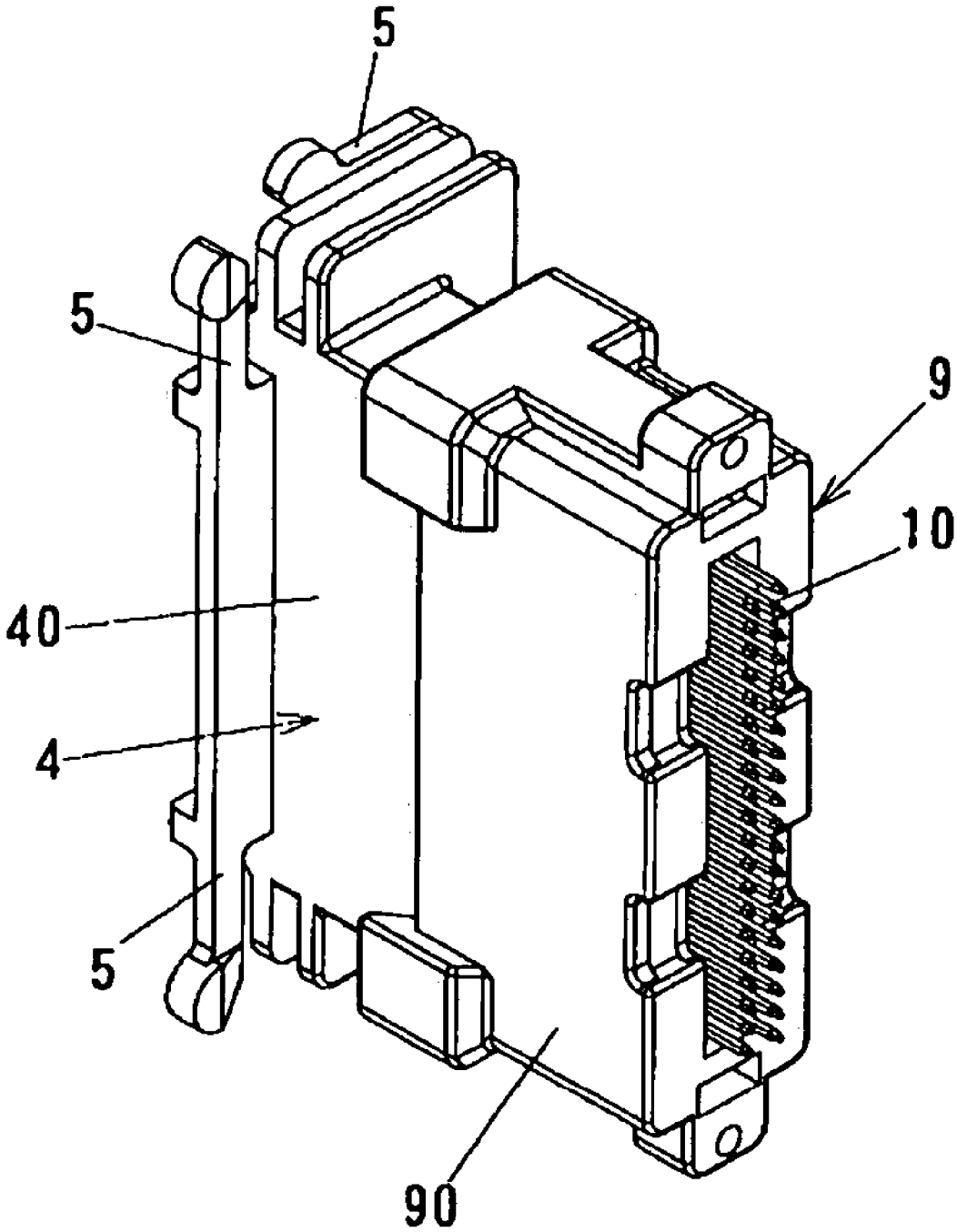
FIG. 3 is a perspective view illustrating a coupling state.

FIG. 2 is a view illustrating the panel 1, as viewed from a front side thereof. As described, the inner case 8 is provided with the number of terminal-inserting holes 7, and with a number of female terminals each being inserted in one of the terminal-inserting holes 7 and connected with a wire harness extending from a power supply. By inserting the male terminals 10 of the male connector 9 disposed at the back side of the accessories, in the terminal-inserting holes 7, the mechanical coupling between the two connectors, i.e., the female connector 4 and the male connector 9 is carried out. Such a coupling state is illustrated in FIG. 3.

Figure 4:
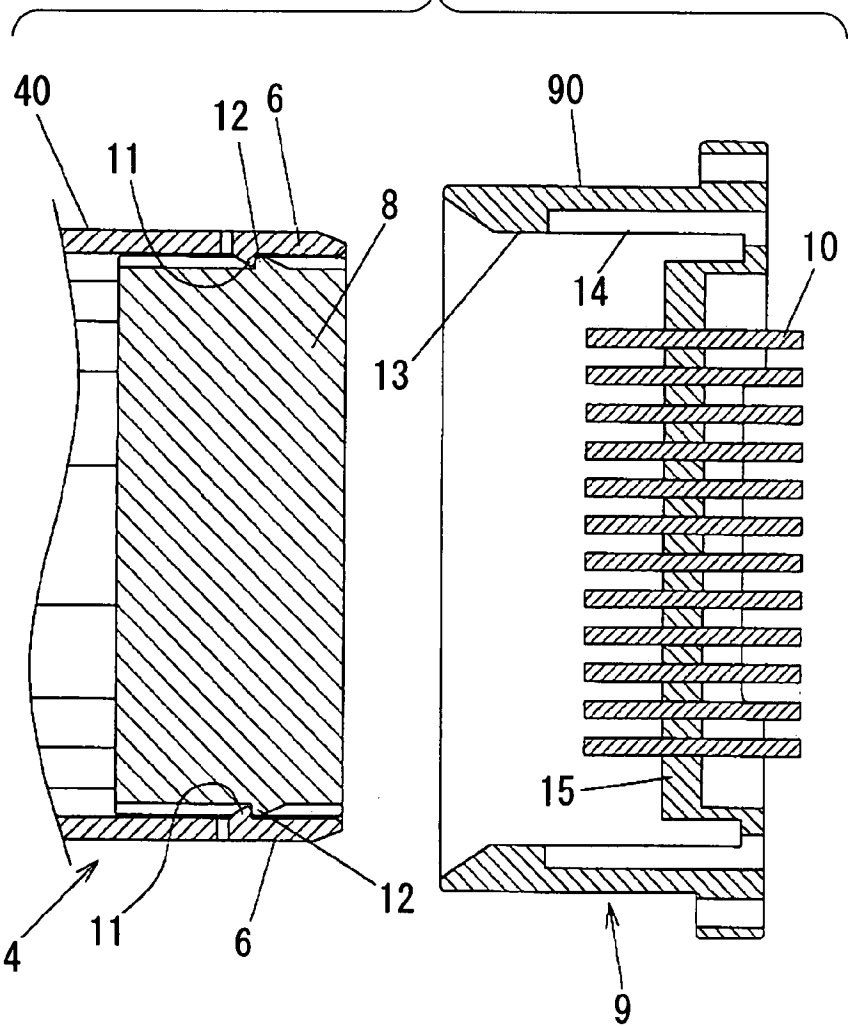
FIG. 4 is a cross sectional view diagrammatically illustrating the connectors before coupling thereof.

Now, coupling operation of said connectors 4 and 9 will be described hereinafter with reference to FIG. 4 and subsequent figures. The pawls 11 are provided inside the notching pieces 6, as described above, and the aforesaid inner case 8 is formed with projecting portions 12. FIG. 4 illustrates a state in which the pawls 11 and the projecting portions 12 are engaged with one another. This state is a state in which the inner case 8 is provisionally secured in position in the housing 40 of the female connector 4. As long as this provisional securement is not released, the inner case 8 does not slide in the housing 40. Further, raised portions 13, which are formed at a front end side of an inner surface of the housing 90, touch an outer surface of the housing 40 with a clearance 14 formed between the inner surface of the housing 90 and the outer surface of the housing 40. A structure is preferable in which a raised portion 13 is formed along the whole periphery of the inner surface of the housing 90. However, another structure is sufficient in which raised portions are formed on the inner surface of the housing 90 each at a location which corresponds to a location of one of the corresponding notching pieces 6. At the time the projecting portions 12 are moved over the pawls 11 of the notching pieces 6, front end portions of the notching pieces 6 are outwardly resiliently deformed or extended. As such, in order to sufficiently receive such deformations or extensions, there is a need to provide the corresponding clearance 14 formed inside the housing 90.

Figure 5:
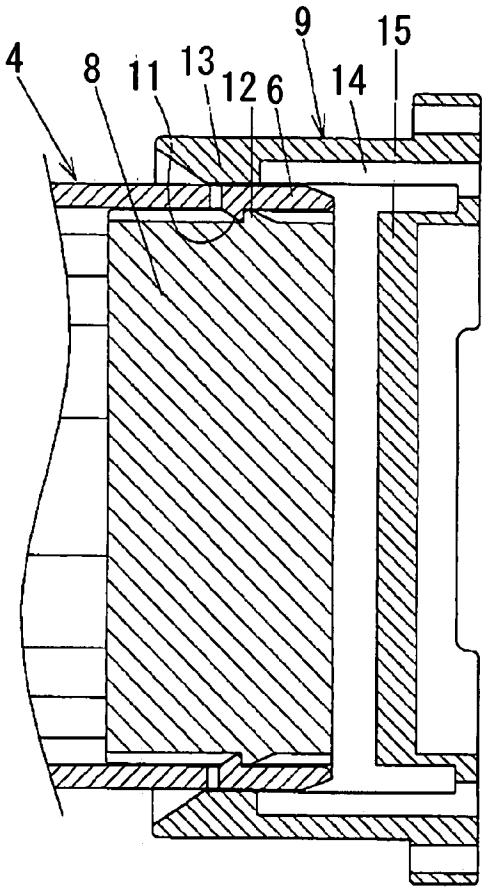
FIG. 5 is a cross sectional view diagrammatically illustrating a state at the beginning of insertion of one housing into another housing.
Figure 7:
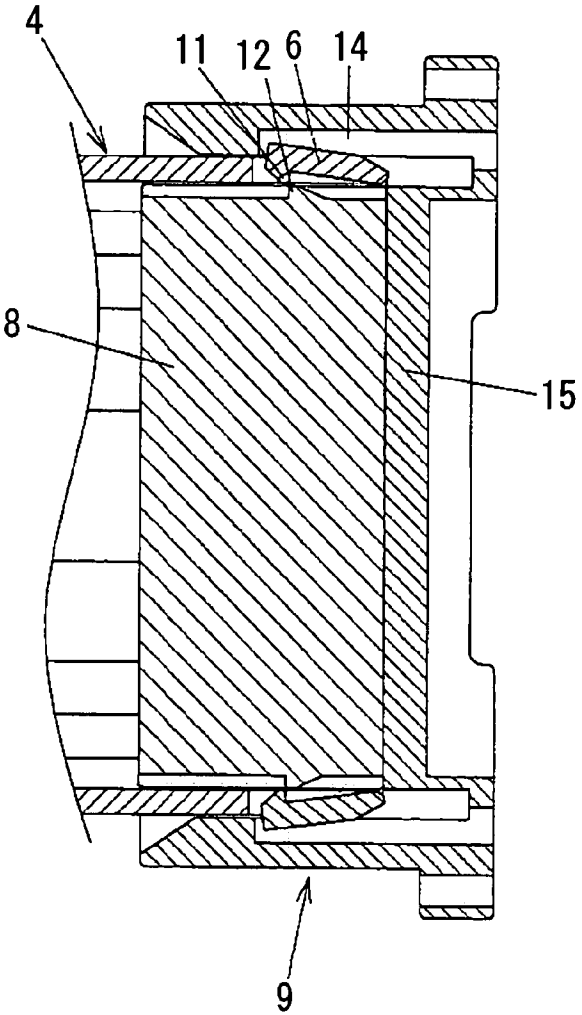
FIG. 7 is a cross sectional view diagrammatically illustrating a cancellation of a provisional securement.
Figure 6:
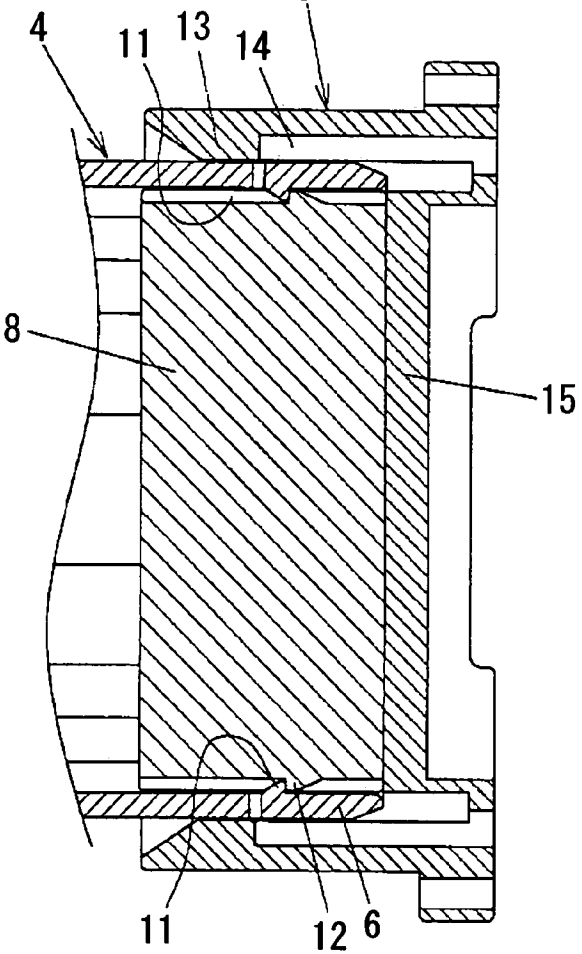
FIG. 6 is a cross sectional view diagrammatically illustrating the middle of the insertion.
Figure 8:
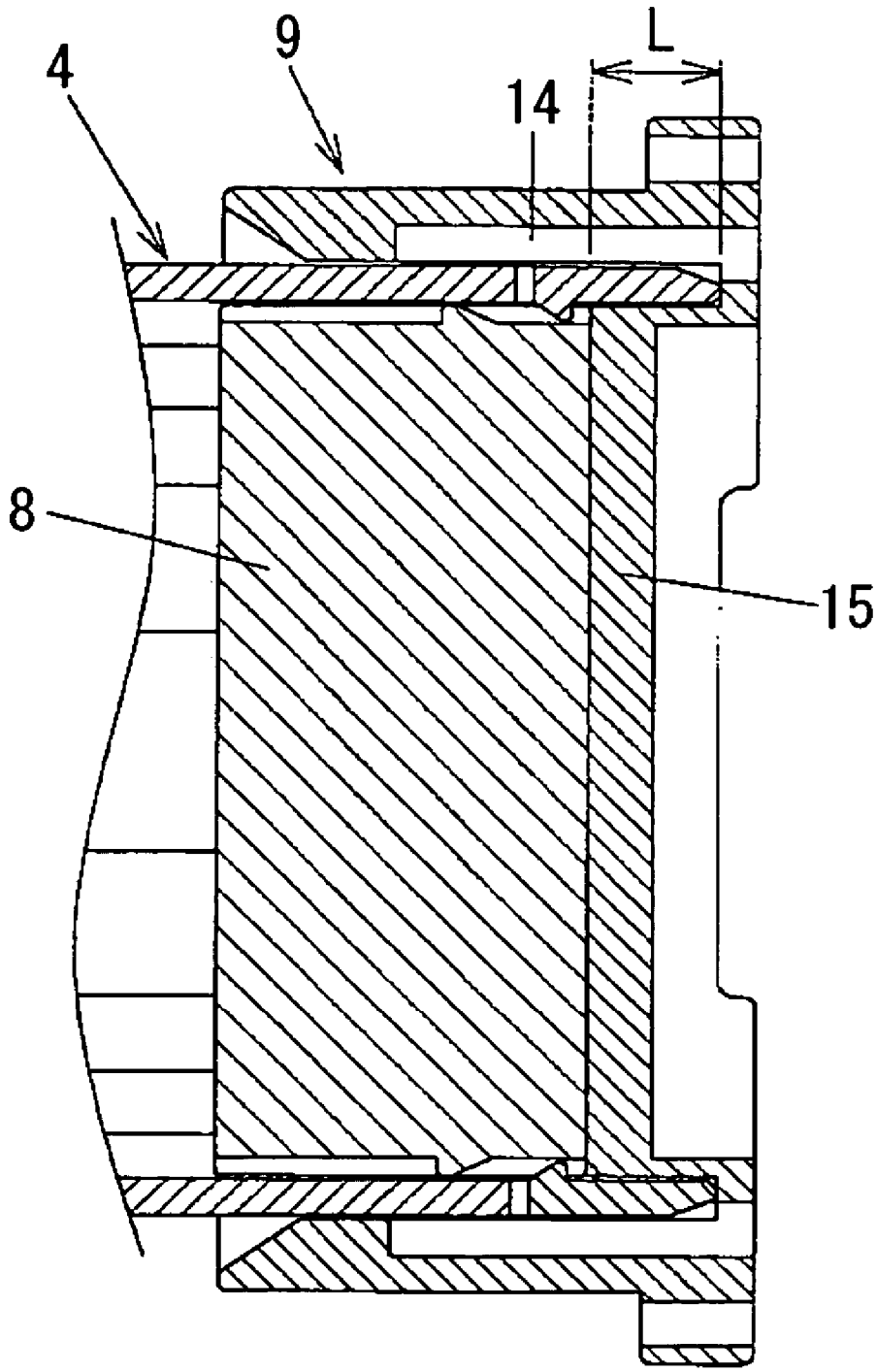
FIG. 8 is a cross sectional view diagrammatically illustrating a coupling state.

Referring to FIGS. 5 and 6, when the male terminals 10 are inserted in the terminal-inserting holes 7, an offset in the X and Y directions is controlled by means of the spring pieces 5, such that the male terminals 10 are inserted in the proper position. FIG. 5 illustrates a state in which the male terminals 10 are correctly inserted in the terminal-inserting holes 7. From thence, the male connector 9 is further inserted and advanced with respect to the female connector 4. A support member 15, by which the male terminals 10 are supported, then abuts against the inner case 8 at a front surface thereof. At this time, the advancement of the inner case 8 is temporarily stopped due to an engagement of the projecting portions 12 of the inner case 8 with the pawls 11. When the male terminals 10 are inserted in the terminal-inserting holes 7, because the inner case 8 is in the provisional securing state as described above, the insertion operation as well as two (X and Y) dimensional adjustment are rendered to be easy. Thereafter, the male connector 9 is further advanced or moved. At this time, as illustrated in FIG. 7, the projecting portions 12 of the inner case 8 ride over the pawls 11 of the notching pieces 6 whereby the front end portions of the notching pieces 6 are outwardly resiliently deformed so that they are received in the clearance 14. The male connector 9 is further advanced or moved until the support member 15 abuts against an end of the housing 40 and thereby stops. FIG. 8 illustrates a state in which the male connector 9 is advanced or inserted to the full extent with respect to the female connector 4. The female connector 4 is slid or moved by a length L from a position corresponding to the provisional securing state, as shown in FIG. 6, to a position corresponding to a coupling-completion state, as shown in FIG. 8. In a case where the connector 9 is inserted so deep in the above position, adjusting thereof is possible by pulling the connector 9.

Second Embodiment

Hereinafter, a second embodiment according to the present invention will be described with reference to FIGS. 9 through 17.

Figure 9:
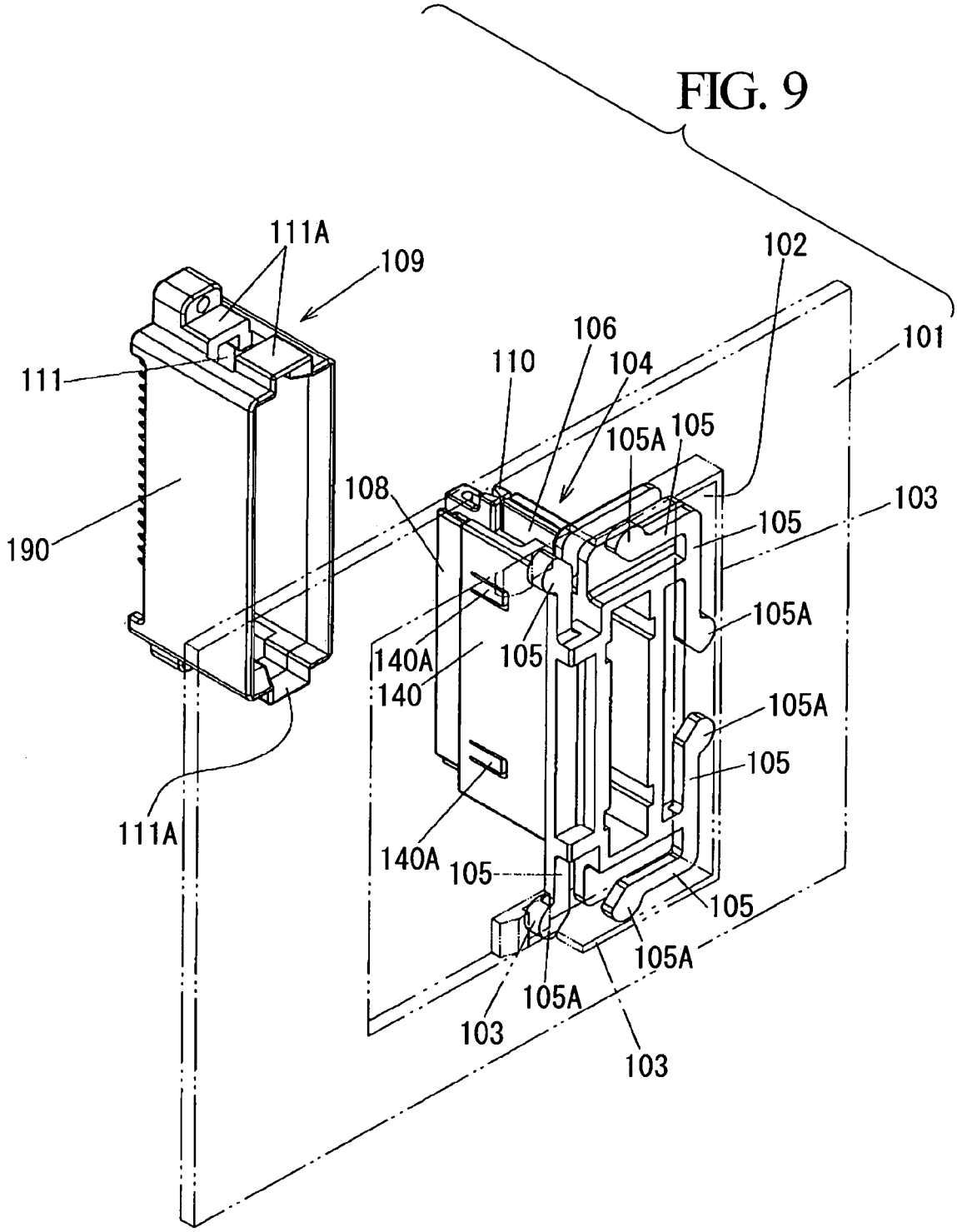
FIG. 9 is a perspective view illustrating a panel before coupling the connectors, as viewed from a back side of the panel, according to a second embodiment of the present invention.

FIG. 9 is a view illustrating a securement state of a female connector 104 with respect to a panel 101, such as an instrument panel or the like, to which one connector is to be secured, when viewed from back of the panel 101. The panel 101 is formed with an opening 102, in which the female connector 104 is mounted. A catching wall 103 is formed along the periphery of the opening 102 at a panel back side. This catching wall 103 is comprised of a portion that is formed in such a manner as to protrude from a back surface of the panel 101, and of a peripheral wall that is flush with the opening 102. On a back surface of the female connector 104 is formed a plurality of spring pieces 105, each of which has a tip 105A that is an outwardly rounded bulging portion.

Each of the tips 105A (or rounded bulging portions) of the spring pieces 105 is brought into resilient contact with the aforesaid catching wall 103 whereby the female connector 104 is secured to the panel 101. The tips 105A of the spring pieces 105 bulge in such a manner as to protrude outwardly from outlines by which the back surface of the female connector 104 is defined. Under a state in which the tips 105A of the spring pieces 105 are in resilient contact with the catching wall 103, positioning control of the female connector 104 in X and Y axial directions is possible. When a housing 140 of the female connector 104 is molded from a resin material, the aforesaid spring pieces 105 are also integrally formed with the housing 104. The spring pieces 105 are provided on a rectangular-shaped back surface of the connector 104, one at each short side (or each of upper and lower sides) of the rectangular shape and two at each long side (or each of left and right sides) of the rectangular shape.

Further, ribs 106 are provided one at a center position of each of top and bottom portions of a front side of the housing 140 of the female connector 104, each rib extending in a back and forth direction as shown in FIG. 9. An inner case 108 with a number of terminal-inserting holes 107, as more fully discussed hereinafter, is housed in the housing 140 so as to be slidable. U-shaped spring pieces 110 are provided, one at each side of the inner case 108, to latchingly engage the ribs 106. The advancement or insertion of the inner case 108 within the housing 140 is temporarily stopped due to a latching engagement of these U-shaped spring pieces 110 with the ribs 106. Namely, the inner case 108 is provisionally secured in position within the housing 140. Each of the U-shaped spring pieces 110 has a break consisting of opposed portions, a length between which is shorter than a width of each of the ribs 106. When a leading end of the rib 106 is pushed through the break or opposed portions of the U-shaped spring piece, a force is necessary for compulsorily widening the break of the U-shaped spring piece 110.

Figure 16:
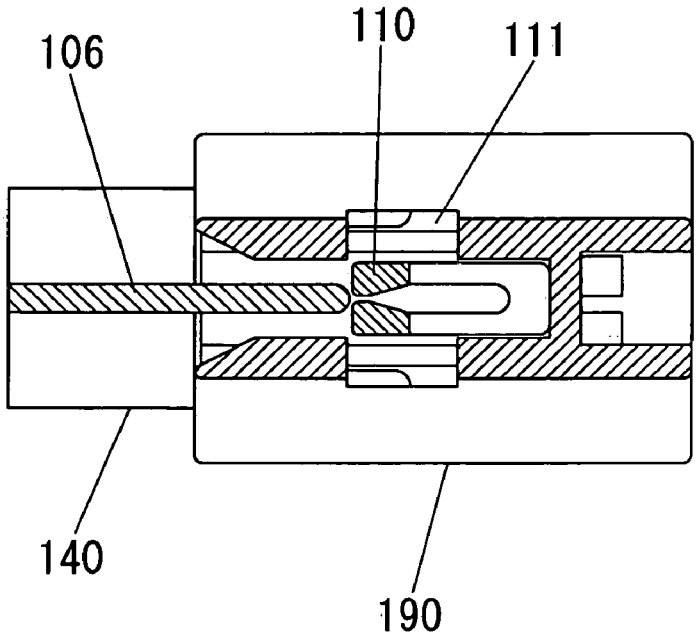
FIG. 16 is a side cross sectional view illustrating deformation permitting windows and U-shaped spring pieces.

A male connector 109 is fitted in the female connector 104. In FIG. 9, a number of male terminals 112 to be inserted in their respective terminal-inserting holes 107 are not illustrated, and instead, a housing 190 to house those male terminals 112 is only illustrated. This housing 190 is fitted on the aforesaid housing 140 in such a manner as to cover the housing 140. The male connector 109 is provided at a back side of accessories such as vehicular meters. Channels 111A are formed, one at each side of the housing 190. The ribs 106 and the U-shaped spring pieces 110 are inserted in the channels 111A in such a manner as to slide. The housing 190 is provided with deflection permitting windows 111 which are formed at intermediate positions of the channels 111A and which enable the break of the U-shaped spring piece 110 to be widened in right and left directions when the inner case 108 is inserted in the channel 111A so that the rib 106 enters the break of U-shaped spring piece. The deflection permitting windows 111 are structured as follows. FIGS. 9 and 16 indicate a provisional securing state in which the leading end of the rib 106 abuts against the break of the U-shaped spring piece or a latching engagement of the inner case 108 and the housing 140 is formed. When the U-shaped spring piece 110 occupies a position corresponding to the deflection permitting window 111, the opposed portions (or break) of the U-shaped spring piece 110 are widened from side to side by a forcible insertion of the rib 106 in the break of the U-shaped spring piece 110. As seen from the foregoing, the deflection permitting window 111 enables the connectors 104 and 109 to be reliably connected to one another, when the housing 140 is further deeply inserted in the housing 190. Further, the deflection permitting window 111 contributes to absorption of an in-depth error.

Figure 10:
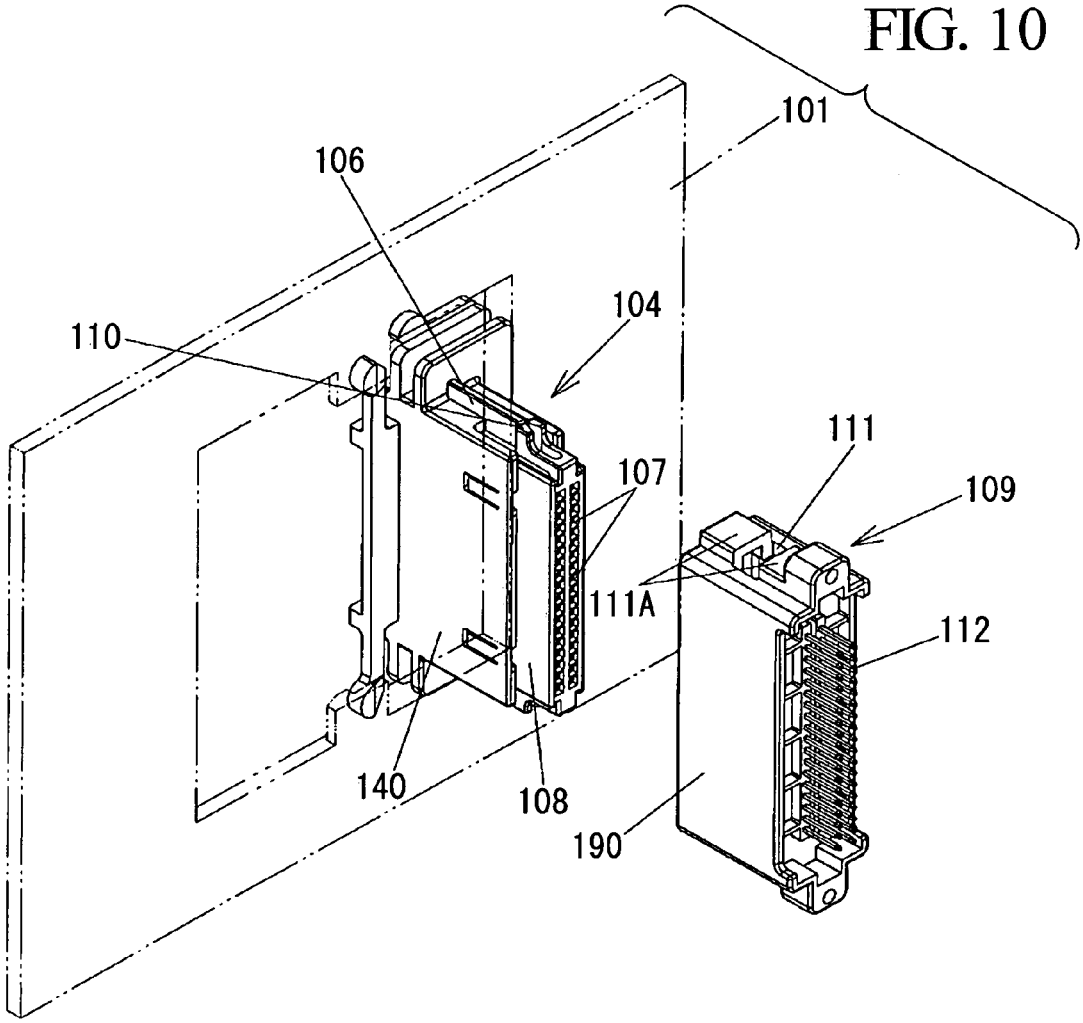
FIG. 10 is a perspective view illustrating the panel before coupling the connectors, as viewed from a front side of the panel.

FIG. 10 is a view illustrating the panel 101, as viewed from a front side thereof. As described, the inner case 108 is provided with the number of terminal-inserting holes 107, and with a number of female terminals each being inserted in one of the terminal-inserting holes and connected with a wire harness extending from a power supply. By inserting the male terminals 112 of the male connector 109 disposed at the back side of the accessories, in the terminal-inserting holes 107, the mechanical coupling between the two connectors, i.e., the female connector 104 and the male connector 109 is carried out. Additionally, pawls 140A formed on the housing 140 engage and disengage with respect to unillustrated projections which are provided on the inner case 108.

Figure 11:
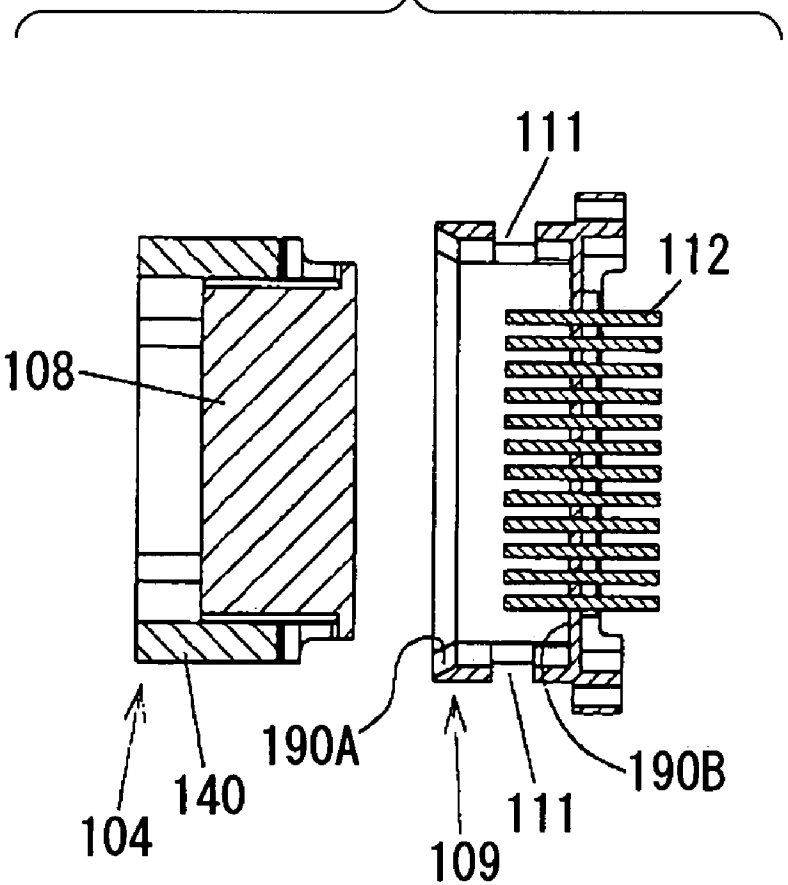
FIG. 11 is a cross sectional view diagrammatically illustrating the connectors before coupling thereof.

Now, coupling operation of the connectors 104 and 109 will be described hereinafter with reference to FIG. 11 and subsequent figures. FIG. 11 illustrates a state in which the ribs 106 and the U-shaped spring pieces 110 are engaged with one another. This state is a state in which the inner case 108 is provisionally secured in position in the housing 140 of the female connector 104. As long as this provisional securement is not canceled, the inner case 108 does not slide in the housing 140. Further, an insertion opening of the housing 190 is formed with a tapered opening 190A which has a diameter widened, and also formed with a bottom portion 190B against which the inner case 108 abuts.

Figure 12:
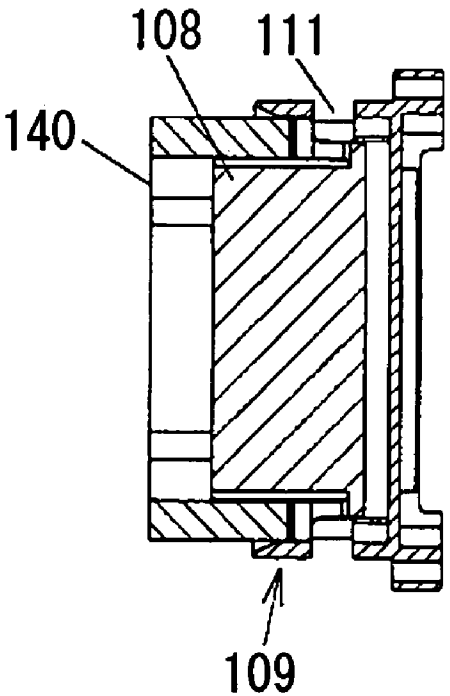
FIG. 12 is a cross sectional view diagrammatically illustrating a state at the beginning of insertion of one housing into another housing.
Figure 15:
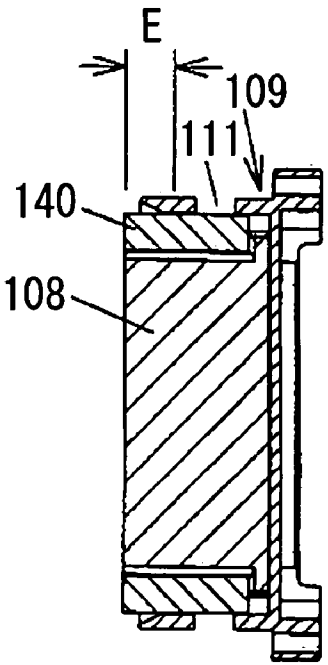
FIG. 15 is a cross sectional view diagrammatically illustrating a coupling state.
Figure 14:
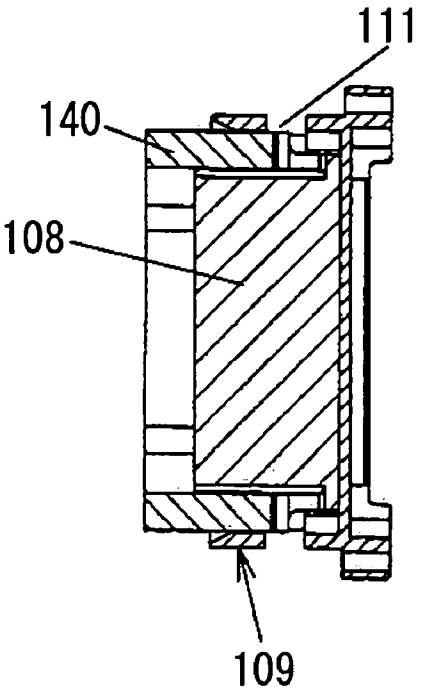
FIG. 14 is a cross sectional view diagrammatically illustrating a cancellation of a provisional securement.
Figure 13:
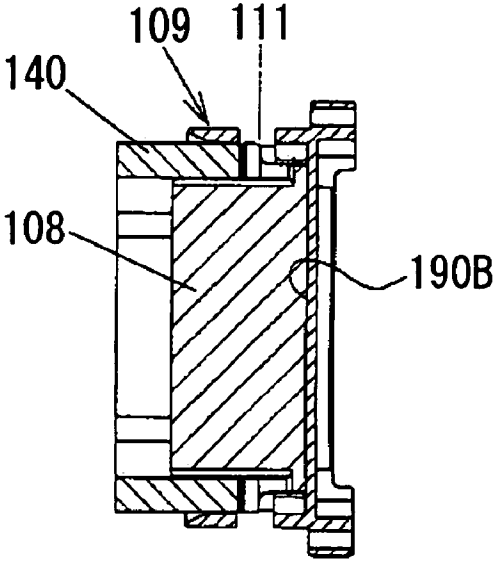
FIG. 13 is a cross sectional view diagrammatically illustrating the middle of the insertion.

Referring now to FIGS. 12 and 13, when the male terminals 112 (not shown in the drawings) are inserted in the terminal-inserting holes 107, an offset in the X and Y directions is controlled by means of the spring pieces 105, such that the male terminals 112 are inserted in the proper position. FIG. 12 illustrates a state in which the male terminals 112 are correctly inserted in the terminal-inserting holes 107. From thence, the male connector 109 is further inserted and advanced with respect to the female connector 104. At this time, the advancement of the inner case 108 is temporarily stopped due to an engagement of the ribs 106 of the housing 140 with the U-shaped spring pieces 110. When the male terminals 112 are inserted in the terminal-inserting holes 107, because the inner case 108 is in the provisional securing state as described above, insertion operation as well as two (X and Y) dimensional adjustment are rendered to be easy. Thereafter, the male connector 109 is further advanced or moved. At this time, as illustrated in FIG. 14, the U-shaped spring pieces 110 are outwardly resiliently deformed against their spring forces such that they are received in the deflection permitting window 111 in such a manner that they are disengaged from the ribs 106. The male connector 109 is further advanced or moved so as to present a state as described in FIG. 15. In a case where the connector 109 is inserted so deep or in the above-described position, adjusting thereof is possible by pulling the connector 109. In FIG. 15, E indicates an absorbable amount of error in the insertion direction.

Figure 17:
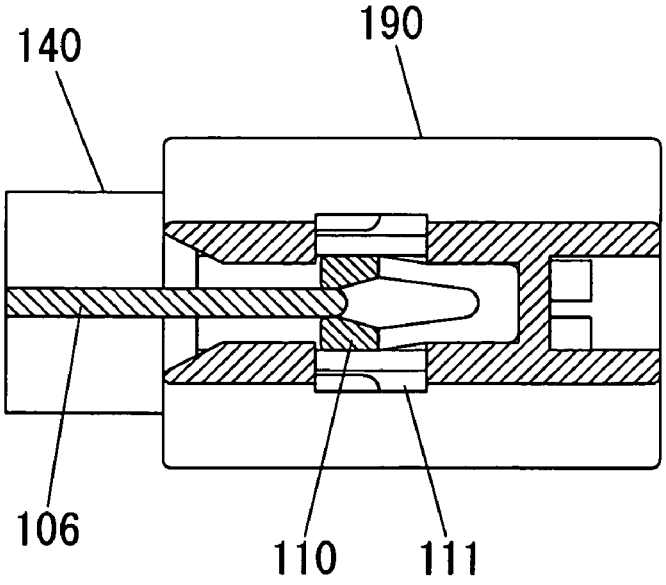
FIG. 17 is a side cross sectional view, which is similar to FIG. 16, illustrating the cancellation of the provisional securement implemented by the U-shaped spring pieces.

FIGS. 16 and 17 are cross sectional side views illustrating the relationship between the deflection permitting windows 111 and the U-shaped spring pieces 110.

While the invention has been particularly shown and described with reference to exemplary embodiments thereof, the present invention is not limited to these embodiments. It will be understood by those of ordinary skill in the art that various changes in form and details may be made therein without departing from the spirit and scope of the invention as defined by the following claims.

What is claimed is:

1. A connector coupling structure comprising a first connector including a housing and a plurality of terminal-inserting holes;

a second connector including a housing and a plurality of terminals which are connectable to said plurality of terminal-inserting holes;

a raised portion which is formed at a front end side of an inner surface of the second connector housing, wherein, when the first and second connectors are coupled, the raised portion is in contact with an outer surface of the first connector housing such that a clearance is formed between the outer surface of the first connector housing and an inner surface portion other than the raised portion of the second connector housing;

an inner case which is slidably received in one of the first connector housing and the second connector housing and which includes one of the plurality of terminal-inserting holes and the plurality of terminals;

a projecting portion which is formed on a side of the inner case; and a notching piece which is formed on said one of the first connector housing and the second connector housing and which includes a pawl which contactingly engages the projecting portion during the coupling process;

wherein, when the plurality of terminals and the plurality of terminal-inserting holes are connected with one another, the inner case is slid which causes the notching piece to resiliently deform outwardly into the clearance such that, upon completion of sliding the inner case, the pawl and the projecting portion are no longer contactingly engaged;

wherein, when the housing of the first connector is mounted to a panel through an opening of the panel, the housing includes a housing body portion, which does not pass through the opening of the panel and said housing body portion is engaged with one surface of the panel, and a plurality of spring pieces, which are resiliently deformable so as to pass through the opening, are resiliently engaged with an other surface of the panel.

2. The connector coupling structure according to claim 1, wherein the first connector is female connector and the second connector is a male connector.

3. The connector coupling structure according to claim 1, wherein the inner case includes the plurality of terminal-inserting holes and is slidably received in the first connector housing.

4. A connector coupling structure comprising a first connector including a housing and a plurality of terminal-inserting holes;

a second connector including a housing and a plurality of terminals which are connectable to said plurality of terminal-inserting holes;

a raised portion which is formed at a front end side of an inner surface of the second connector housing, wherein, when the first and second connectors are coupled, the raised portion is in contact with an outer surface of the first connector housing such that a clearance is formed between the outer surface of the first connector housing and an inner surface portion other than the raised portion of the second connector housing;

an inner case which is slidably received in one of the first connector housing and the second connector housing and which includes one of the plurality of terminal-inserting holes and the plurality of terminals;

a projecting portion which is formed on a side of the inner case; and a notching piece which is formed on said one of the first connector housing and the second connector housing and which includes a pawl which contactingly engages the projecting portion during the coupling process;

wherein, when the plurality of terminals and the plurality of terminal-inserting holes are connected with one another, the inner case is slid which causes the notching piece to resiliently deform outwardly into the clearance such that, upon completion of sliding the inner case, the pawl and the projecting portion are no longer contactingly engaged;

wherein, when the housing of the second connector is mounted to a panel through an opening of the panel, the housing includes a housing body portion, which does not pass through the opening of the panel and said housing body portion is engaged with one surface of the panel, and a plurality of spring pieces, which are resiliently deformable so as to pass through the opening, are resiliently engaged with an other surface of the panel.

5. A connector coupling structure comprising:

a first connector including a housing and a plurality of terminal-inserting holes;

a second connector including a housing and a plurality of terminals which are connectable to said plurality of terminal-inserting holes;

an inner case which is slidably received in one of the first connector housing and the second connector housing and which includes one of the plurality of terminal-inserting holes and the plurality of terminals;

a U-shaped spring piece which is provided on a side of the inner case;

a rib which is provided on said one of the first connector housing and the second connector housing, and during coupling comes in contact with the U-shaped spring piece, wherein, when the rib abuts with the U-shaped spring piece, sliding movement of the inner case in said one of the first connector housing and the second connector housing is stopped;

a channel which is provided on a side of the other connector housing of the first and second connector housings and which guides a movement of the rib and the U-shaped spring piece; and a deflection permitting window which is provided partway along the channel for receiving a resiliently deformable portion of the U-shaped spring piece;

wherein, when said one of said first connector housing and said second connector housing, in which the inner case has been partway received, and said other connector housing are fitted to each other, the U-shaped spring piece of the inner case comes to a position corresponding to the deflection permitting window in such a manner that the deflection permitting window allows the U-shaped spring piece to open enabling insertion of the rib therein.

6. The connector coupling structure according to claim 5, wherein the first connector is a female connector and the second connector is a male connector.

7. The connector coupling structure according to claim 5, wherein the inner case includes the plurality of terminal-inserting holes and is slidably received in the first connector housing.

8. The connector coupling structure according to claim 5, wherein, when the housing of the first connector is mounted to a panel through an opening of the panel, the housing includes a housing body portion, which does not pass through the opening of the panel and said housing body portion is engaged with one surface of the panel, and a plurality of spring pieces, which are resiliently deformable so as to pass through the opening are resiliently engaged with an other surface of the panel.

9. The connector coupling structure according to claim 5, wherein, when the housing of the second connector is mounted to a panel through an opening of the panel, the housing includes a housing body portion, which does not pass through the opening of the panel and is engaged with one surface of the panel, and a plurality of spring pieces, which are resiliently deformable so as to pass through the opening and are resiliently engaged with an other surface of the panel.

10. A connector coupling structure comprising:

a female connector housing;

a male connector housing;

wherein, when said female and male connector housings are coupled, a clearance is formed between the outer surface of the female connector housing and an inner surface of the male connector housing;

an inner case slidably receivable in one of said female and male connector housings;

a projecting portion formed on a side of the inner case; and a notching piece formed on said one of said female and male connector housings, said notching piece having a pawl which contactingly engages with the projecting portion of said inner case during the coupling process;

wherein, when said female and male connectors are coupled, the inner case is slid which allows the notching piece to resiliently deform outwardly into the clearance such that, upon completion of sliding the inner case, the pawl and the projecting portion are no longer contactingly engaged.

11. A connector coupling structure comprising:

a female connector housing;

a male connector housing;

an inner case slidably receivable in one of said female connector housing and said male connector housing;

a U-shaped spring piece provided on a side of the inner case;

a rib provided on said one of said female connector housing and said male connector housing, which during coupling comes in contact with the U-shaped spring piece, wherein when the rib abuts the U-shaped spring piece, sliding movement of the inner case in said one of said female connector housing and said male connector housing is stopped;

a channel provided on the other of said one of said female connector housing and said male connector housing, which guides a movement of the rib and the U-shaped spring piece; and a deflection permitting window which is provided on the channel for receiving a resiliently deformable portion of the U-shaped spring piece, wherein when said male and female connector housings are fitted to each other, the deflection permitting window allows the U-shaped spring piece to open enabling insertion of the rib therein.

* * * * *